US005998355A

United States Patent [19]

Brumbaugh

[11] Patent Number: 5,998,355

[45] Date of Patent: Dec. 7, 1999

[54] LIQUID DISHWASHING DETERGENT

[75] Inventor: Ernest H. Brumbaugh, Rockford, Mich.

[73] Assignee: Amway Corporation, Ada, Mich.

[21] Appl. No.: 08/976,900

[22] Filed: Nov. 24, 1997

Related U.S. Application Data

[63] Continuation of application No. 08/559,552, Nov. 16, 1995.

[51] Int. Cl.[6] ..... C11D 1/12; C11D 1/83

[52] U.S. Cl. ..... 510/424; 510/235; 510/427; 510/434

[58] Field of Search ..... 510/235, 236, 510/237, 424, 437, 503, 505, 427, 434

[56] References Cited

U.S. PATENT DOCUMENTS

| | | | |
|---|---|---|---|
| 3,427,248 | 2/1969 | Lambertti et al. | 252/117 |
| 4,206,070 | 6/1980 | Jones . | |
| 4,426,310 | 1/1984 | Verunica . | |
| 4,483,779 | 11/1984 | Llenado et al. . | |
| 4,483,780 | 11/1984 | Llenado . | |
| 4,492,646 | 1/1985 | Welch . | |
| 4,743,394 | 5/1988 | Kaufmann et al. . | |
| 4,780,249 | 10/1988 | Pittz et al. | 252/547 |
| 4,954,292 | 9/1990 | Hull et al. . | |
| 5,389,282 | 2/1995 | Saijo et al. | 252/174.17 |
| 5,403,509 | 4/1995 | Pujol et al. | 252/174.22 |
| 5,425,891 | 6/1995 | Pujol et al. . | |
| 5,599,785 | 2/1997 | Mondin et al. | 510/417 |
| 5,653,970 | 8/1997 | Vermeer | 424/70.24 |

FOREIGN PATENT DOCUMENTS

WO 95/23204 8/1995 WIPO .

OTHER PUBLICATIONS

International Cosmetic Ingredient Dictionary, Seventh Edition, vol. 1, 1997.

*Primary Examiner*—Yogendra Gupta
*Assistant Examiner*—Gregory E. Webb
*Attorney, Agent, or Firm*—Brinks Hofer Gilson & Lione; G. Peter Nichols

[57] ABSTRACT

Liquid dishwashing detergent compositions are prepared that exhibit increased viscosity, better dissolution rate and surprisingly improved cleaning performance in hard water, comprising from about 1% to about 90% of an anionic surfactant and from about 1% to about 30% of a solvent hydrotrope selected from the group consisting of alkoxylated glycerides, alkoxylated glycerines, esters of alkoxylated glycerines, alkoxylated fatty acids, esters of glycerin, polyglycerol esters and combinations thereof.

22 Claims, No Drawings

LIQUID DISHWASHING DETERGENT

This application is a continuation of application Ser. No. 08/559,552, filed Nov. 16, 1995.

BACKGROUND OF THE INVENTION

This invention relates to light duty dishwashing detergents, and in particular, to light duty dishwashing detergent compositions that contain a fatty acid or glycerine derivative as a hydrotrope.

The term "dishes" as used in the following description indicates utensils that maybe required to be washed free from food particles and other food residues, greases, proteins, starches, gums, dyes, oil, and burnt organic residues.

Light duty liquid detergents, such as are suitable for use in the washing of dishes, are well known and have met with a high degree of consumer acceptance because of their good washing and foaming properties and convenient form for use. Many current dishwashing formulations contain anionic surfactants that may gel unless prevented by various solvents or hydrotropes. Hydrotropes are viscosity controlling agents, gel suppressants, stability agents and dispersability aids. Commonly used hydrotropes include alcohols and alcohol derivatives including glycols and alkoxylated alcohols.

A perceived problem with alcohols and glycols is that the amount required to achieve formulation stability may be enough to reduce overall levels of viscosity of the composition to an extent that consumers may believe they are not receiving an optimum dishwashing formulation. High levels-of alcohol can also effect the perception of the fragrance used in the composition and affect consumer perception of the product. In addition, both alcohols and glycols can produce less than optimum dissolution rates. Moreover, alcohols are flammable and thus present hazardous conditions. Alcohols can also contribute to the drying of a user's hands.

The present invention solves these problems by replacing the commonly used hydrotropes in whole or in part with a hydrotrope selected from the group consisting of alkoxylated glycerides, alkoxylated glycerines, esters of alkoxylated glycerin, alkoxylated fatty acids, esters of glycerin and polyglycerol esters and combinations thereof.

The hydrotrope of the present invention provides optimum viscosity and composition stability compared to the current formulae in industry. Surprisingly, it has also been found that the hydrotrope of the present invention improves the cleaning performance of the detergent composition in hard water, increases the dissolution rate and increase the mildness of the detergent composition.

SUMMARY OF THE INVENTION

The present invention relates to a dishwashing detergent composition having from about 1 to about 90% of an anionic surfactant and further employing from about 1% to about 30% of a solvent hydrotrope selected from the group consisting of alkoxylated glycerides, alkoxylated glycerines, esters of alkoxylated glycerines, alkoxylated fatty acids, esters of glycerin, polyglycerol esters and combinations thereof.

In a preferred embodiment, the anionic surfactant contains at least one sulfur group. The dishwashing detergent may also contain from about 1% to about 40% of a surfactant component selected from the group consisting of nonionic surfactants, amphoteric surfactants and combinations thereof. Known adjuvants and additives such as perfumes, fragrances, and the like may also be present at nominal levels with an aggregate of less than about 10% by weight of the composition. Water may comprise the balance.

Unexpectedly, it has been found that dishwashing-detergents that incorporate the hydrotrope of the present invention exhibit optimum viscosity and formula stability, improved dispersability and improved cleansing performance in hard water compared to commonly used detergent compositions containing only alcohol or alcohol derivatives as the hydrotrope.

It is noted that, unless otherwise stated, all percentages given in this specification and the appended claims refer to percentages by weight.

It is also noted that the hardness values, as used in this specification and the appended claims, is intended to refer to hardness expressed as calcium carbonate.

These and other objects, advantages, and features of the present invention will be better understood upon review of the following detailed description of the preferred embodiments.

DETAILED DESCRIPTION OF THE PREFERRED EMBODIMENTS

The liquid dishwashing detergent composition of the present invention includes an anionic surfactant and a solvent hydrotrope selected from the group consisting of alkoxylated glycerines, alkoxylated glycerides, esters of alkoxylated glycerin, esters of glycerin, alkoxylated fatty acids, polyglycerol esters and combinations thereof.

Anionic surfactants useful in a detergent formulation of the present invention include but are not limited to those that are listed in McCutcheon's *Emulsifiers & Detergents*, Annual 1992; and in U.S. Pat. No. 5,298,195 assigned to the same assignee of the present invention, both references are incorporated herein by reference.

Anionic surfactants particularly useful in the present invention include those containing at least one sulfur group. Thus, for example, the anionic surfactant useful in the present invention include sulfated and sulfonated anionic surfactants. Useful sulfated anionic surfactants include but are not limited to primary and secondary alkyl sulfates, primary and secondary sulfates of ethoxylated alcohols, and sulfates of fatty esters. Useful sulfonated anionic surfactants include but are not limited to sulfonates of alkylbenzene, sulfonates of dodecyl benzene, sulfonates of tridecylbenzene, primary and secondary alkyl sulfonates, alpha olefin sulfonates, sulfonates of naphthalene and alkyl naphthalene, and sulfonates of petroleum. Other useful anionic surfactants containing a sulfur group include but are not limited to sarcosinates, sulfosuccinamates, sulfosuccinates and taurates. In addition, anionic surfactants with a carboxyl group are also useful in the present invention. Anionic surfactants with a carboxyl group include salts of fatty acids, commonly referred to as soaps, and carboxylated alcohol ethoxylates, commonly referred to as carboxylates. Particular examples of these anionic surfactants include but are not limited to those that can be found in McCutcheon's.

The particularly preferred anionic surfactants of the present invention include ether sulfates. Ether sulfates include, for example, the alkyl ether sulfates such as polyoxyethylene alkyl ether sulfates and tridecyl ether sulfates, alkyl ether sulfates derived from natural alcohol such as sodium lauryl alcohol polyglycol ether sulfates and fatty alcohol ether sulfates, alkyl ether sulfates derived from synthetic alcohol, and ether sulfates derived from aliphatic carboxylic acids such as sodium lauryl ether sulfates, sodium myristyl ether sulfates, polyoxyethylene lauryl ether sulfates, triethanolamine lauryl ether sulfates, and ammonium lauryl ether sulfates.

The amount of anionic surfactant present in a detergent composition in accordance to the present invention ranges from about 1% to about 90%, preferably from about 5% to about 70%, with from about 15% to about 50% being particularly preferred.

The hydrotrope of the present invention includes alkoxylated glycerines such as ethoxylated glycerines and alkoxylated glycerides such as ethoxylated glycerides. Ethoxylated glycerines and ethoxylated glycerides are preferred because they are biodegradable.

The ethoxylated glycerines useful in the present invention have the following general structure:

(I)

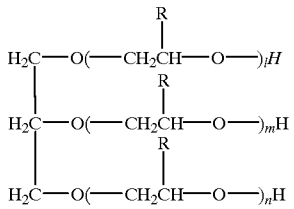

wherein: "l", "m", "n" are each a number from 0 to about 20, with l+m+n=from about 2 to about 60, preferably from about 10 to about 45, and R represents H, $CH_3$, or $C_2H_5$.

The ethoxylated glycerines of Formula (I) can be prepared according to conventional methods, for example, by the reaction of glycerine and ethylene oxide in the presence of an alkaline catalyst such as KOH or NaOH. Examples of the preparation of ethoxylated glycerine can be found in U.S. Pat. No. 5,425,891 to Pujol et al., which is incorporated herein by reference.

The ethoxylated glycerides useful in the present invention are the ethoxylated mono- and diglycerides and can be prepared according to conventional methods, for example, by reaction of ethylene oxide with mono- or diglyceride fats. The ethoxylated glycerides useful in the present invention have the following general structure:

(II)

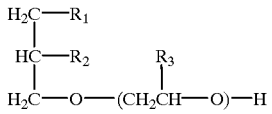

wherein: $R_1$ and $R_2$ are each

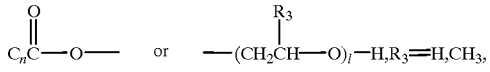

or $C_2H_5$, and "l" is a number from about 1 to about 60 and "n" is a number from about 6 to about 24.

Examples of ethoxylated glycerides useful in the present invention include but are not necessarily limited to ethoxylated monoglycerides, and ethoxylated diglycerides. A particularly preferred ethoxylated glyceride is an ethoxylated monoglyceride.

The hydrotrope of the present invention further includes esters of alkoxylated glycerines. The esters of alkoxylated glycerines useful in the present invention can be prepared according to conventional methods, for example, by alkolysis of an alkoxlyated glycerine by an acid chloride. Particular examples of esters of alkoxylated glycerines useful in the present invention include but are not limited to those that can be found in McCutcheon's.

The hydrotrope of the present invention additionally includes alkoxylated fatty acids. The alkoxylated fatty acids useful in the present invention can be prepared according to conventional methods, for example, by reacting a fatty acid with ethylene oxide in the presence of an alkaline catalyst such as KOH or NaOH.

Useful alkoxylated fatty acids of the present invention include but are not limited to polyethylene glycol esters of fatty acids, polyoxyethylene esters of fatty acids, carboxylic acid polyglycol esters, fatty acid polyglycol esters and polypropylene glycol esters of fatty acids. Particular examples of alkoxylated fatty acids include but are not limited to those that can be found in McCutcheon's.

The hydrotrope of the present invention further includes esters of glycerin. The esters of glycerin useful in the present invention can be prepared according to conventional methods such as alkolysis of glycerin with an acid chloride. Particular examples of esters of glycerin useful in the present invention include but are not limited to those that can be found in McCutcheon's.

The hydrotrope of the present invention also includes polyglycerol esters. The esters of polyglycerol useful in the present invention can be prepared according to conventional methods. Polyglycerol can be prepared by dehydration of glycerin using alkaline catalysts such as sodium hydroxide. The polyglycerol is then further esterified with a fatty acid to form a polyglycerol ester. Particular examples of polyglycerol esters useful in the present invention include but are not limited to those that can be found in McCutcheon's.

The amount of solvent hydrotrope present in the detergent composition in accordance to the present invention ranges from about 1% to about 30%, preferably from about 2% to about 20%. More preferably, the solvent hydrotrope is present at about 3% to about 10%, with from about 4% to about 8% particularly preferred.

The solvent hydrotrope in accordance to the present invention may contain combinations of the above-described components as well as individual compounds.

The detergent composition of the present invention may also include other surfactants such as nonionic and amphoteric surfactants. Nonionic surfactants useful in the present invention include but are not limited to alkanolamides, amine oxides, alkoxylated alcohols and phenols, block polymers, alkoxylated amines, alkyl polysaccharides, glucosamides, sugar esters and combinations thereof. Particular examples of nonionic surfactants include but are not limited to those that can be found in McCutcheon's and U.S. Pat. No. 5,298,195. Amphoteric surfactants include mono- and diacetates, betaines, glycinates, imidazolines and their derivatives, isethionates, mono- and diproprionates, hydroxy sultaines, and taurates. Particular examples of amphoteric surfactants include but are not limited to those that can be found in McCutcheon's. The amount these surfactant components present in the detergent composition ranges from about 1% to about 40%, preferably from about 15% to about 40%.

Moreover, the present invention may contain optional ingredients such as alkalinity sources, acidifying agents, pH buffering agents; and pH control agents. Examples of acidifying agents include but are not limited to citric acid, acetic acid, benzoic acid, phenol and palmitic acid. Examples of pH control agents include but are not limited to alkali metal carbonates and bicarbonates, monoethanolamine, triethanolamine, tris hydroxy methylamine, ammonium hydroxide, alkaline metal earths, and alkali metal hydroxides. The mono-, di-, and triethanolamines are preferred and can be added up to a level of about 5%.

Builders may also be added, although they have limited value in dishwashing compositions. Either inorganic or organic builders may be used alone or in combination with themselves. Examples of such builders include but are not limited to alkali metal carbonates, phosphates, polyphosphates, and silicates.

Sequestrants can also be incorporated into the compositions. Examples of sequestrants include but are not limited to the alkali metal polycarboxylates, such as sodium and potassium citrate, sodium and potassium tartrate, citric acid, sodium and potassium ethylenediaminetetraacetate (EDTA), triacetates, sodium and potassium nitrilotriacetates (NTA), and mixtures thereof. Up to about 5% of sequestrants can be used.

In addition, the detergent compositions of the present invention can contain, if desired, other optional ingredients including any of the usual adjuvants, diluents, and additives such as perfumes, enzymes, dyes, anti-tarnishing agents, antimicrobial agents, abrasives, hand softening agents such as aloe vera gel, water soluble salts of alkaline earth metals such as magnesium sulfate, and the like, provided that they do not detract from the advantageous properties of the compositions in accordance to the present invention.

The compositions can contain up to about 10% of these optional ingredients.

It is understood that the amount of water comprising the balance of the detergent composition of the present invention can be varied depending upon the desired concentration of the final product.

The following examples are given to illustrate the compositions of the invention.

EXAMPLES

In the examples the abbreviations used have the following meanings:

| Abbreviation | Description |
|---|---|
| CDEA | Coconut diethanolamide |
| CAPAO | Cocamidopropyl amine oxide |
| SLES | Sodium lauryl ethoxy sulfate |

The dishwashing detergent in the following examples contain common composition (Composition A): COMPOSITION A

| COMPOSITION A | |
|---|---|
| Component | Weight % |
| SLES | 22.5 |
| CDEA | 18.0 |
| CAPAO | 4.5 |
| Citric Acid | 0.9 |

A comparative detergent formulation (Formulation X) was prepared by adding the following composition of common hydrotropes (Composition B) to Composition A:

| COMPOSITION B | |
|---|---|
| Component | Weight % |
| Propylene glycol | 5 |
| Nonionic surfactant $C_{11}$, with 7 moles EO | 2.5 |

The viscosity of Formulation X, as measured by ASTM Method number D1200, #4 Ford Cup, is 60 seconds centipoise.

Example 1

Detergent formulations containing a hydrotrope in accordance to the present invention and Composition A were evaluated for formulation clarity, viscosity and dissolution rate as compared to Formulation X.

Table 1 summarizes the results.

TABLE 1

| Formulation | Solvent/Hydrotrope | Weight Percent Used[1] | Formulation Clarity[2] | Viscosity[3] (centipoise) | Dissolution Rate[4] |
|---|---|---|---|---|---|
| 1 | PEG-4 Laurate | 5 | separated | | |
| 2 | PEG-4 Laurate & Propylene Glycol | 2.5 + 2.5 | clear | 70 | |
| 3 | PEG-8 Laurate | 5 | clear | 67 | > Formulation X |
| 4 | PEG-9 Laurate | 5 | clear | 69 | > Formulation X |
| 5 | Glycereth-7 Trioctanoate | 5 | separated | | |
| 6 | Glycereth-7 Trioctanoate + Propylene Glycol | 2.5 + 2.5 | clear | 49 | |
| 7 | Glycereth-26 Trioctanoate | 5 | clear | 63 | >> Formulation X |
| 8 | Glycereth-26 Trioctanoate | 3 | clear | 65 | >> Formulation X |
| 9 | Glycereth-26 Trioctanoate | 1 | clear | 93 | |
| 10 | Glycereth-26 Trioctanoate + Hexylene Glycol | 1 + 1 | clear | 62 | ≧ Formulation X |

TABLE 1-continued

| Formulation | Solvent/Hydrotrope | Weight Percent Used[1] | Formulation Clarity[2] | Viscosity[3] (centipoise) | Dissolution Rate[4] |
|---|---|---|---|---|---|
| 11 | Glycerol Tri(2-ethyl hexanoate) | 5 | separated | | |
| 12 | Glycerol Tri(2-ethyl hexanoate) + Propylene Glycol | 2.5 + 2.5 | clear | 62 | |
| 13 | PEG-18 Glyceryl Oleate/Laurate | 5 | clear | 79 | > Formulation X |
| 14 | Polyglyceryl-4 Isostearate | 5 | separated | | |
| 15 | Polyglyceryl-4 Isostearate + Propylene Glycol | 2.5 + 2.5 | clear | 59 | > Formulation X |
| 16 | Polyglyceryl-3 Oleate | 5 | separated | | |
| 17 | Polyglyceryl-3 Oleate + Propylene Glycol | 2.5 + 2.5 | clear | 59 | > Formulation X |
| 18 | PEG-3 Glyceryl Laurate | 5 | clear | 80 | << Formulation X |
| 19 | PEG-20 Glyceryl Laurate | 5 | clear | 82 | < Formulation X |
| 20 | PEG-7 Glyceryl Cocoate | 5 | clear | 65 | >> Formulation X |
| 21 | PEG-7 Glyceryl Cocoate | 3 | clear | 80 | ≧ Formulation X |
| 22 | PEG-7 Glyceryl Cocoate | 1 | clear | 103 | |
| 23 | Glycereth-26 | 3 | clear | 64 | >> Formulation X |
| 24 | Glycereth-26 | 1 | clear | 92 | > Formulation X |
| 25 | Glycereth-26 + Propylene Glycol | 1 + 1 | clear | 77 | = Formulation X |

[1]Amount of hydrotrope used, in weight percent.
[2]Formulation resulted in clear solution, or separated solution.
[3]Measured with ASTM D1200
[4]As compared with Formulation X Of the formulations tested, those containing the hydrotropes ethoxylated glycerin, esters of ethoxylated glycerin, ethoxylated fatty acids and ethoxylated monoglycerides show acceptable formula stability and dispersability. Detergent formulations containing glycerin esters and polyglycerol esters show acceptable formula stability and dispersability when the hydrotropes are used in combination with glycols.

Example 2

Dishwashing performance tests were conducted to evaluate dishwashing formulations containing Composition A and a hydrotrope in accordance to the present invention against a comparative detergent formulation containing Compositions A and B. All detergent formulations were tested with 0.075% Crisco Soil at 120° F.

In a first test, Mini-Dish Test I, water having a hardness of 15 ppm and 450 ppm were used. In a second test, Mini-Dish Test II, water having a water hardness of 450 ppm was used. The results of Mini-Dish Test I are shown in TABLE 2. The results of Mini-Dish Test II are shown in TABLE 3.

TABLE 2

Mini-Dish Test I

| Run | Hydrotrope/Solvent | Amount of Hydrotrope (wt %) | Dishwashing Performance (No. of Plates) water hardness 15 ppm | 450 ppm |
|---|---|---|---|---|
| 1 | Propylene Glycol + Nonionic Surfactant $C_{11}$-7EO (Composition B) | 5 +2.5 | 11 | 9.5 |
| 2 | Glycereth-26 | 3 | 11+ | 10.5 |
| 3 | Glycereth-26 Trioctanoate | 3 | 10.5 | 10.5 |

TABLE 2-continued

Mini-Dish Test I

| Run | Hydrotrope/Solvent | Amount of Hydrotrope (wt %) | Dishwashing Performance (No. of Plates) water hardness 15 ppm | 450 ppm |
|---|---|---|---|---|
| 4 | PEG-7 Glyceryl Cocoate | 3 | 10.5 | 9.5 |

TABLE 3

Mini-Dish Test II

| Run | Hydrotrope/Solvent | Amount of Hydrotrope (wt %) | Dishwashing Performance (No. of Plates) water hardness 450 ppm |
|---|---|---|---|
| 1 | Propylene Glycol + Nonionic Surfactant $C_{11}$-7EO (Composition B) | 5 +2.5 | 10 |
| 2 | Glycereth-26 Trioctanoate | 3 | 11 |
| 3 | Glycereth-26 | 3 | 10.75 |
| 4 | PEG-4 Laurate + Propylene Glycol | 2.5 +2.5 | 10.5 |
| 5 | PEG-18 Glyceryl Oleate/Laurate | 5 | 10+ |
| 6 | PEG-20 Glyceryl Laurate | 5 | 10 |
| 7 | PEG-9 Laurate | 5 | 9.5 |
| 8 | Polyglyceryl-3 Oleate + Propylene Glycol | 2.5 +2.5 | 9.5 |
| 9 | Glycerol Tri(2-ethylhexanoate) + Propylene Glycol | 2.5 +2.5 | 8.5 |

Of the formulations tested, those containing the hydrotropes ethoxylated glycerin, esters of ethoxylated glycerin, ethoxylated fatty acids and ethoxylated monoglycerides show good dishwashing performance.

In accordance to a preferred embodiment of the present invention, a dishwashing detergent composition consists essentially of from about 1% to about 90% of an anionic surfactant selected from the group consisting of primary and secondary alkyl sulfates, primary and secondary sulfates of ethoxylated alcohols, sulfates of fatty esters, sulfonates of alkylbenzene, sulfonates of dodecyl benzene, sulfonates of tridecylbenzene, primary and secondary alkyl sulfonates, alpha olefin sulfonates, sulfonates of naphthalene and alkyl naphthalene, sulfonates of petroleum, sarcosinates, sulfosuccinamates, sulfosuccinates, taurates, salts of fatty acids, carboxylated alcohol ethoxylates, ether sulfates and combinations thereof, from about 1% to about 30% of a solvent hydrotrope selected from the group consisting of alkoxylated glycerines, alkoxylated glycerides, esters of alkoxylated glycerines, alkoxylated fatty acids, esters of glycerin, polyglycerol esters and combinations thereof, from about 1% to about 40% of surfactants selected from the group consisting of nonionic surfactants such as alkanolamides, amine oxides, alkoxlyated alcohols, alkoxylated phenols, block polymers, alkoxylated amines, alkyl polysaccharides, glucosamides, sugar esters and combinations thereof, and amphoteric surfactants such as monoacetates, diacetates, betaines, glycinates, imidazolines and their derivatives, isethionates, monoproprionates, diproprionates, hydroxy sultaines, taurates and combinations thereof, and up to about 10% additives.

Of course, it should be understood that a wide range of changes and modifications can be made to the embodiments described above. It is therefore intended that the foregoing description illustrates rather than limits this invention, and that it is the following claims, including all equivalents, which define this invention.

What is claimed is:

1. A light-duty liquid detergent composition consisting of:

a. from about 1% to about 90% of an anionic surfactant;

b. from about 1% to about 30% of a solvent hydrotrope selected from the group consisting of alkoxylated glycerines, alkoxylated fatty acids, polyglycerol esters and combinations thereof;

c. from about 1% to about 40% of a surfactant component selected from the group consisting of nonionic surfactants, amphoteric surfactants and combinations thereof.

2. The composition of claim 1 wherein the amount of anionic surfactant present is from about 5% to about 70%.

3. The composition of claim 1 wherein the amount of solvent hydrotrope present is from about 2% to about 20%.

4. The composition of claim 1 wherein the nonionic surfactant is selected from the group consisting of alkanolamides, amine oxides, alkoxlyated alcohols, alkoxylated phenols, block polymers, alkoxylated amines, alkyl polysaccharides, glucosamides, sugar esters and combinations thereof.

5. The composition of claim 1 wherein the amphoteric surfactant is selected from the group consisting of monoacetates, diacetates, betaines, glycinates, imidazolines, imidazoline derivatives, isethionates, monoproprionates, diproprionates, hydroxy sultaines and combinations thereof.

6. The composition of claim 1 wherein the anionic surfactant contains at least one sulfur group.

7. The composition of claim 1 wherein the anionic surfactant is selected from the group consisting of sulfated anionic surfactants, sulfonated anionic surfactants, sulfosuccinamates, sulfosuccinates, taurates, salts of fatty acids, carboxylated alcohol ethoxylates, ether sulfates and combinations thereof.

8. The composition of claim 1 wherein the anionic surfactant is an ether sulfate anionic surfactant.

9. The composition of claim 1 wherein the amount hydrotrope present is from about 3% to about 10%.

10. The composition of claim 1 wherein the amount hydrotrope present is from about 4% to about 8%.

11. The composition of claim 1 wherein the amount anionic surfactant is from about 15% to about 50%.

12. The composition of claim 1 wherein the amount of the anionic surfactant component is from about 15% to about 40%.

13. A light-duty liquid detergent composition consisting of:

a. from about 15% to about 50% of a sulfate anionic surfactant selected from the group consisting of primary and secondary alkyl sulfates, primary and secondary sulfates of ethoxylated alcohols, sulfates of fatty esters, sulfonates of alkylbenzene, sulfonates of dodecyl benzene, sulfonates of tridecylbenzene, primary and secondary alkyl sulfonates, alpha olefin sulfonates, sulfonates of naphthalene and alkyl naphthalene, sulfonates of petroleum, sarcosinates, sulfosuccinamates, sulfosuccinates, taurates, salts of fatty acids and carboxylated alcohol ethoxylates, ether sulfates and combinations thereof;

b. from about 3% to about 10% of a solvent hydrotrope selected from the group consisting of alkoxylated glycerines, alkoxylated fatty acids, polyglycerol esters and combinations thereof;

c. from about 0% to about 10% of additives; and, d. water comprising the balance.

14. The composition of claim 13 wherein the anionic surfactant is an ether sulfate anionic surfactant.

15. A light-duty liquid detergent composition consisting of:

a. from about 15% to about 50% of a sulfate anionic surfactant selected from the group consisting of primary and secondary alkyl sulfates, primary and secondary sulfates of ethoxylated alcohols, sulfates of fatty esters, sulfonates of alkyl benzene, sulfonates of dodecyl benzene, sulfonate of tridecylbenzene, primary and secondary alkyl sulfonates, alpha olefin sulfonates, sulfonates of naphthalene and alkyl naphthalene, sulfonates of petroleum, sarcosinates, sulfosuccinamates, sulfosuccinates, taurates, salts of fatty acids and carboxylated alcohol ethoxylates, ether sulfates and combinations thereof;

b. from about 3% to about 10% of a solvent hydrotrope selected from the group consisting of alkoxylated glycerines, alkoxylated fatty acids, polyglycerol esters and combinations thereof;

c. from about 1% to about 40% of a surfactant component selected from the group consisting of nonionic surfactants, amphoteric surfactants and combinations thereof;

d. from about 0% to about 10% of additives; and, e. water comprising the balance.

16. A liquid dishwashing detergent composition consisting of:

a. from about 15% to about 50% of an ether sulfate anionic surfactant;

b. from about 4% to about 8% of a solvent hydrotrope selected from the group consisting of alkoxylated glycerides, alkoxylated glycerines, esters of alkoxylated glycerines, alkoxylated fatty acids, esters of glycerin, polyglycerol esters and combinations thereof;

c. from about 15% to about 40% of a surfactant component selected from the group consisting of nonionic surfactants, amphoteric surfactants and combinations thereof;

d. from about 0% to about 10% of additives; and, e. water comprising the balance.

17. The composition of claim 16 wherein the nonionic surfactant is selected from the group consisting of alkanolamides, amine oxides, alkoxlyated alcohols, alkoxylated phenols, block polymers, alkoxylated amines, alkyl polysaccharides, glucosamides, sugar esters and combinations thereof.

18. The composition of claim 16 wherein the amphoteric surfactant is selected from the group consisting of monoacetates, diacetates, betaines, glycinates, imidazolines, imidazoline derivatives, isethionates, monoproprionates, diproprionates, hydroxy sultaines and combinations thereof.

19. The composition of claim 1 wherein said solvent hydrotrope is selected from alkoxylated glycerines.

20. The composition of claim 13 wherein said solvent hydrotrope is selected from alkoxylated glycerines.

21. A light-duty liquid detergent composition consisting of:

a. from about 1% to about 90% of an anionic surfactant;

b. from about 1% to about 30% of a solvent hydrotrope selected from the group consisting of alkoxylated glycerines, alkoxylated fatty acids, polyglycerol esters and combinations thereof;

c. from about 1% to about 40% of a surfactant component selected from the group consisting of nonionic surfactants, amphoteric surfactants and combinations thereof; and d. citric acid.

22. A light-duty liquid detergent composition consisting of:

a. from about 15% to about 50% of a sulfate anionic surfactant selected from the group consisting of primary and secondary alkyl sulfates, primary and secondary sulfates of ethoxylated alcohols, sulfates of fatty esters, sulfonates of alkylbenzene, sulfonates of dodecyl benzene, sulfonate of tridecylbenzene, primary and secondary alkyl sulfonates, alpha olefin sulfonates, sulfonates of naphthalene and alkyl naphthalene, sulfonates of petroleum, sarcosinates, sulfosuccinamates, sulfosuccinates, taurates, salts of fatty acids and carboxylated alcohol ethoxylates, ether sulfates and combinations thereof;

b. from about 3% to about 10% of a solvent hydrotrope selected from the group consisting of alkoxylated glycerines, alkoxylated fatty acids, polyglycerol esters and combinations thereof;

c. from about 0% to about 10% of additives;

d. citric acid; and, e. water comprising the balance.

* * * * *